US006175089B1

(12) United States Patent
Kang

(10) Patent No.: US 6,175,089 B1
(45) **Date of Patent: *Jan. 16, 2001**

(54) MULTI-POSITION AUTOMATIC SWITCHING ACTUATOR FOR LOAD SWITCH

(75) Inventor: Kyeong Rok Kang, Cheongju (KR)

(73) Assignee: LG Industrial Systems Co., Ltd., Seoul (KR)

( * ) Notice: Under 35 U.S.C. 154(b), the term of this patent shall be extended for 0 days.

This patent is subject to a terminal disclaimer.

(21) Appl. No.: 09/001,554

(22) Filed: Dec. 31, 1997

(51) Int. Cl.[7] ..... H01H 5/04
(52) U.S. Cl. ..... 200/400
(58) Field of Search ..... 200/400, 401, 200/424; 218/154

(56) References Cited

U.S. PATENT DOCUMENTS 5,113,056 * 5/1992 Kuhn ..... 200/400
5,224,590 * 7/1993 Milianowicz et al. ..... 200/400
5,226,528 * 7/1993 Schaeffer et al. ..... 200/400
5,274,206 * 12/1993 Milianowicz ..... 200/400
5,276,288 * 1/1994 Erickson et al. ..... 200/400
5,504,293 * 4/1996 Rogers et al. ..... 218/154

* cited by examiner

*Primary Examiner*—Renee Luebke

(57) ABSTRACT

A multi-position automatic switching actuator for a load switch includes an oil pressure cylinder member operated by power, a latch releasing member rotating in accordance with the operation of the oil pressure cylinder member, a latch member fixedly engaged to the latch releasing member and rotating in accordance with the rotation of the latch releasing member, a latch stopping member connected to the latch member and limiting the rotation of the latch member by a predetermined angle, an elastic member disposed between the latch releasing member and the latch member for instantly rotating the latch member, and a central shaft inserted through the latch member. The actuator appropriately switches a contact position to another and carries out a multi-position switching control by employing a single actuator, thereby simplifying production, decreasing production cost, and securing safety in work operations.

27 Claims, 13 Drawing Sheets

MULTI-POSITION AUTOMATIC SWITCHING ACTUATOR FOR LOAD SWITCH

BACKGROUND OF THE INVENTION

1. Field of the Invention

The present invention relates to a load switch, and ore particularly to an improved multi-position automatic switching actuator for a load switch which makes it possible to appropriately switch one contact point to another and carry out a 3-position (open-close-earth) switch control and multi-position switch control by employing a single actuator.

2. Description of Related Art

In general, a load switch employs a power distribution system. The power distribution system includes an overhead power distribution line and a subterranean power distribution line, and allows electrical power supplied from a first substation to provide power to power receiving devices for power consumers. Such a load switch may be used to partition and branch power lines for the subterranean power lines.

As shown in FIG. 1, the load switch according to the conventional art includes a main body 1, four switching actuators 100 respectively disposed at upper portions of the main body 1 for making a movable contact move, and a plurality of three-phase main bushes 2 positioned at lower portions of the switching actuators 100 for receiving power from a first substation and selectively supplying or interrupting power to power receiving facilities of respective electric loads under the control of the switching actuators 100.

In a conventional load switch, the switching actuator 100 actuates respective movable contacts for the power received from one of the main bushes 2 depending upon its demand, thereby either supplying the power to another of the main bushes 2 or to respective power consumers, or interrupting the power supply.

The switching actuator for the conventional load switch will now be described.

As shown in FIGS. 2 and 5B, the switching actuator for the conventional load switch, known as a toggle-type control device, carries out a two-position contact switching. The switching actuator includes: a base plate 120; a driving shaft unit 130 disposed at a central portion behind the base plate 120 and having a driving shaft 132 protrudingly formed from a marginal end surface thereof; a subordinate driving shaft link unit 140 having a through hole 142 formed through an end portion thereof through which the driving shaft 132 extends so as to be coupled with the driving shaft unit 130; a spring 150 having a left end portion 151 hooked on a hook protrusion 134 extending backwardly from another end portion of the driving shaft unit 130, and another end portion 152 hooked on a protrusion 144 extending from an end portion of the subordinate driving shaft link unit 140; a central shaft unit 160 disposed below a portion at which the driving shaft unit 130 and the subordinate driving shaft link unit 140 are coupled with each other, and an end portion of which is movably engaged to a link 143; and a control handle 110 disposed at a front portion of the base plate 120 and having an insertion protrusion (not shown) formed at a center so as to be engaged to the driving shaft 132.

The base plate 120 includes a through hole (not shown) formed in a center thereof, and arc openings 121 for controlling a rotation of the driving shaft 132 are formed at left and right sides of the through hole (not shown).

As shown in FIGS. 4A and 4B, the driving shaft unit 130 includes: a stable arm 131; the driving shaft 132 extending from an end portion of the stable arm 131, wherein an insertion opening (not shown) is formed in an end portion of the driving-shaft 132 so that the control handle 110 is engaged in the insertion opening (not shown); a limit protrusion 133 protruding from the stable arm 131 to limit the rotation of the driving shaft unit 130; and the hook protrusion 134 extending from an end portion of the stable arm 131 so as to rotate in correspondence to the rotation of the driving shaft 132.

In the above constituted driving shaft unit 130, the hook protrusion 134 is hooked on the one end portion 151 of the spring 150, and the limit protrusion 133 is inserted into the arc opening 121 formed in the base plate 120, so that the rotation of the driving shaft unit 130 is limited accordingly.

As shown in FIGS. 5A and 5B, the subordinate driving shaft link unit 140 includes: a pair of stable pads 141; the link 143 provided between the pair of stable pads 141; the through hole 142 formed at the end of the stable pads 141 and having the driving shaft 132 extending therethrough; the hook protrusion 144 extending from another end portion of the stable pads 141 and being moved by the elasticity of the spring 150; and a limit protrusion 145 extending from a portion of the stable pads 141.

Also, in a center of each of the stable pads 141, an insertion hole (not shown) is formed which receives an insertion protrusion 146 therethrough.

In the subordinate driving shaft link unit 140, the hook protrusion 144 is hooked on the other end portion 152 of the spring 150, and the limit protrusion 145 is inserted into the other arc opening 121 formed in the base plate 120 to limit the rotation of the subordinate driving shaft link unit 140.

The link 143 includes insertion openings 143*a* formed in each end portion thereof. The insertion protrusion 146 of the stable pads 141 and an insertion protrusion 163 extending from a portion of the central shaft unit 160 are correspondingly inserted into the respective insertion openings 143*a*, whereby the rotation force of the subordinate driving shaft link unit 140 is transferred to the central shaft unit 160.

The central shaft unit 160, as shown in FIG. 2, includes a central shaft 162, and a stable arm 161 having an insertion protrusion 163. The central shaft 162 extends from another end portion of the unit 160.

The operational steps of a conventional two-position switching actuator for a load switch according to the manual control method will now be described with reference to the accompanying drawings.

As shown in FIGS. 2, 3 and 6–8, when the control handle 110 is gradually rotated in the clockwise direction, the rotational force of the control handle 110 is transferred to the driving shaft unit 130 through the driving shaft 132 connected thereto. As a result, driving shaft unit 130 gradually rotates in the clockwise direction.

When the driving shaft unit 130 rotates in the clockwise direction, the hook protrusion 134 formed at the end portion of the driving shaft unit 130 rotates gradually in the clockwise rotation, thereby causing tension at the spring 150 hooked on the hook protrusion 134 (FIG. 7).

When the limit protrusion 133 of the driving shaft unit 130 reaches an end portion of one arc opening 121 of the base plate 120 after the continuous rotation of the driving shaft unit 130, the hook protrusion 144 extending from the end portion of the rear surface of the suborinate driving shaft link unit 140 instantly makes a counter-clockwise rotation in accordance with the elastic restoration force of the spring 150 (FIG. 8), whereby the subordinate driving shaft unit 140 rotates counter-clockwise.

When the subordinate driving shaft link unit 140 rotates in the counter-clockwise direction, the central shaft 162 connected to the link 143 makes a counter-clockwise rotation, thereby switching a contact position.

However, although such a two-position (open-close) switch operation may be completely carried out using the conventional switching actuator, more than two switching actuators are needed in order to perform other switching operations, such as a 3-position (open-close-earth) or a 4-position (open-close-open-close) contact switching operation.

Consequently, the conventional two-position contact switching actuator is inconvenient to use and the applicability of the conventional switching actuator is limited.

In addition, since an operator has to directly operate the load switch to control the conventional switching actuator, the conventional switch operation is time consuming and dangerous to the operator.

SUMMARY OF THE INVENTION

Accordingly, it is an object of the present invention to provide a multi-position automatic switching actuator for a load switch which appropriately switches a contact point to another and carries out a 3-position (open-close-earth) switching, and a multi-position switching by employing a single actuator.

It is another object of the present invention to provide a multi-position automatic switching actuator for a load switch, capable of remotely controlling a contact switching operation.

To achieve the above-described and other objects, there is provided a multi-position automatic switching actuator for a load switch according to the present invention which includes an oil pressure cylinder member operated by power, a latch releasing member rotated in accordance with the oil pressure cylinder, a latch member fixedly engaged to the latch releasing member and rotating in accordance with a rotation of the latch releasing member, a latch stopping member connected to the latch member and limiting a rotation of the latch member by a predetermined angle, an elastic member disposed between the latch releasing member and the latch member for rotating the latch member, and a central shaft inserted into the latch member.

The objects and advantages of the present invention will become more readily apparent from the detailed description given hereinafter. However, it should be understood that the detailed description and specific examples, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
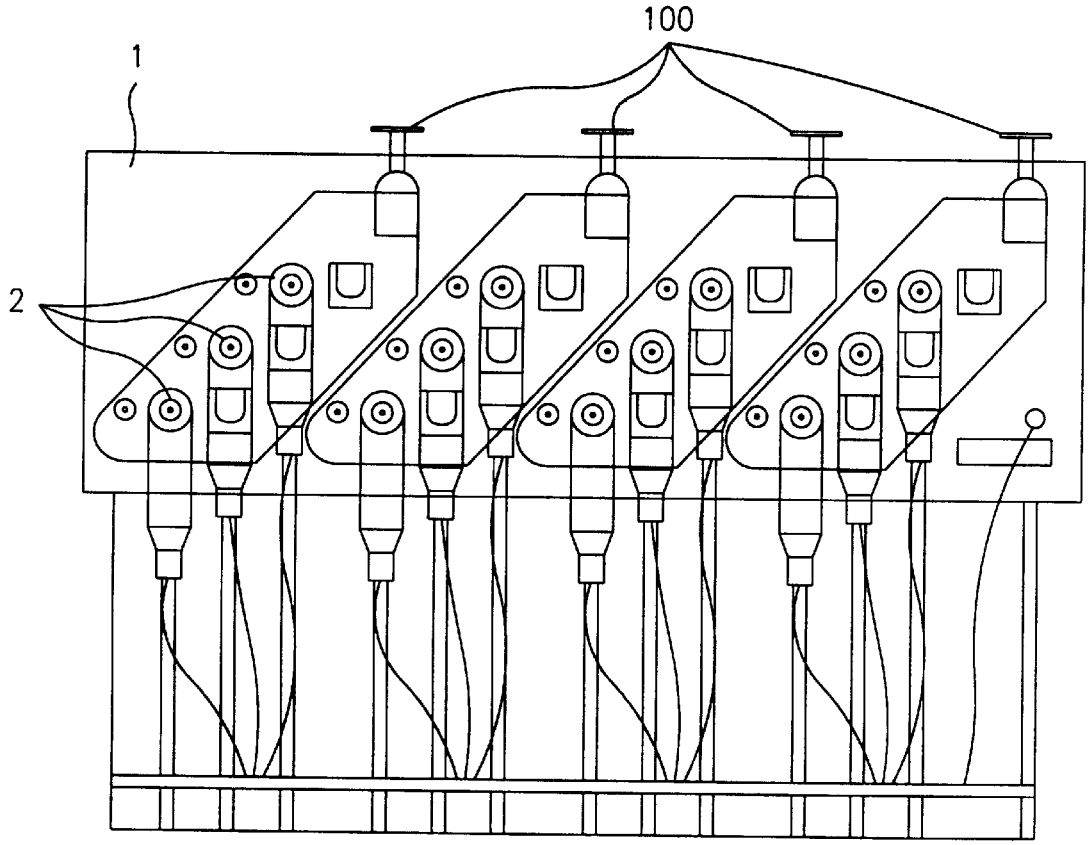
FIG. 1 CONVENTIONAL ART
FIG. 1 is a front view illustrating a conventional load switch.
Figure 2:
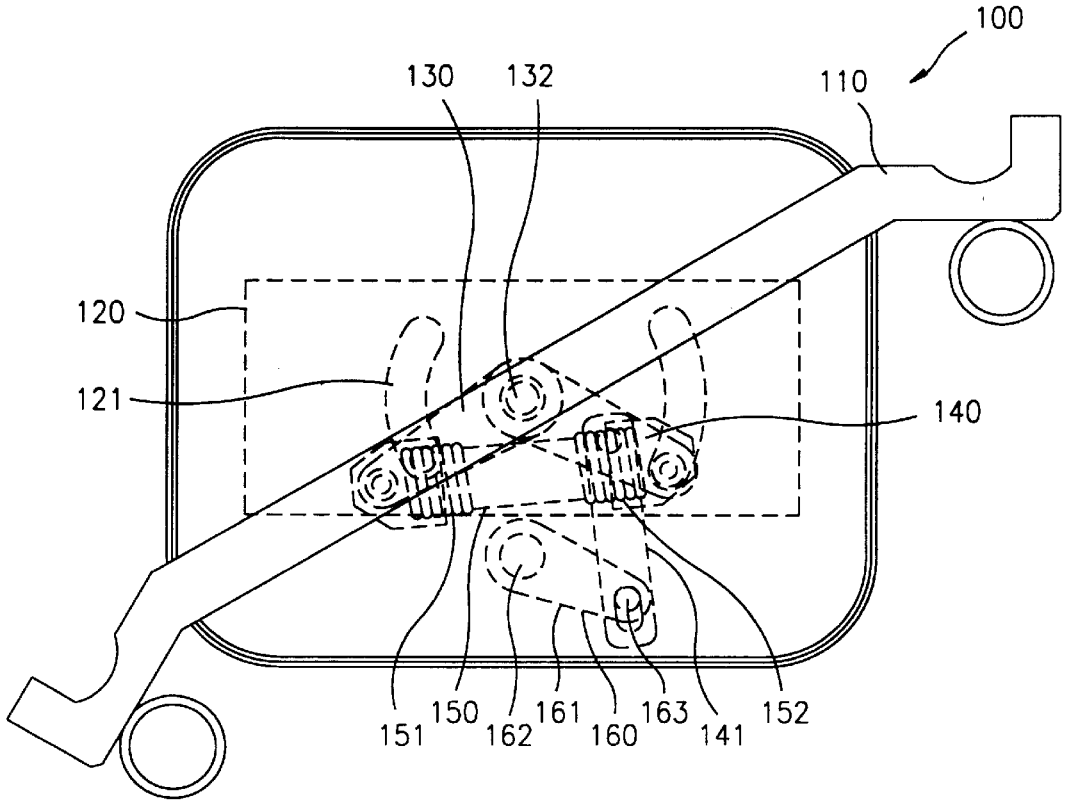
FIG. 2 CONVENTIONAL ART
FIG. 2 is a front view illustrating a two-position switching actuator for the conventional load switch of FIG. 1.
Figure 3:
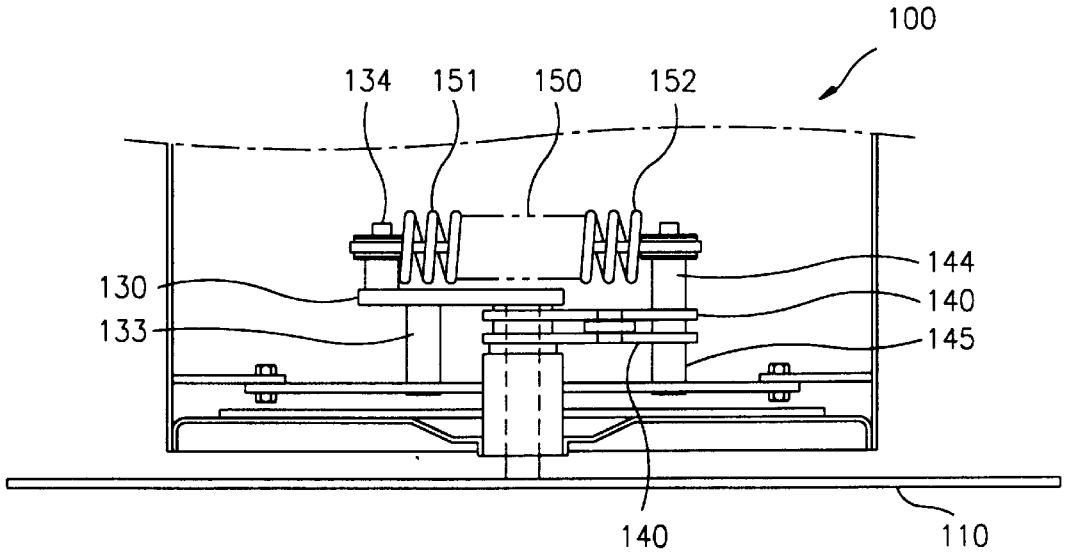
FIG. 3 CONVENTIONAL ART
FIG. 3 is a plan view illustrating the two-position switching actuator in FIG. 2.
Figure 4A:
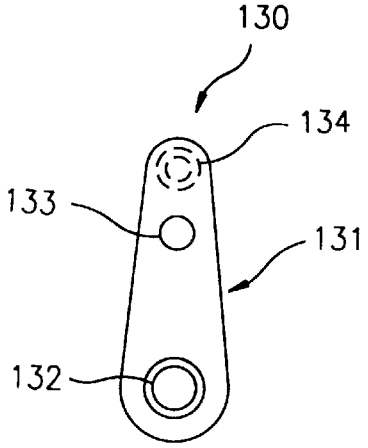
FIG.4A CONVENTIONAL ART
FIG. 4A is a front view illustrating a driving shaft unit of the conventional two-position switching actuator in FIG. 2.
Figure 4B:
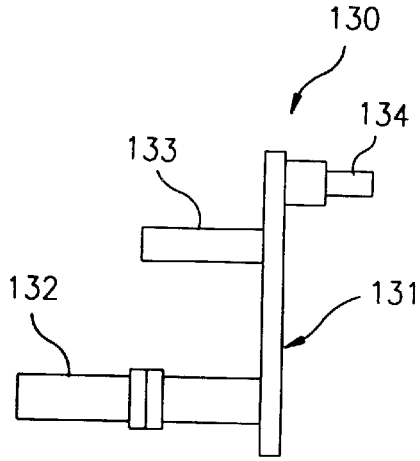
FIG.4B CONVENTIONAL ART
FIG. 4B is a side view illustrating the driving shaft unit in FIG. 4A.
Figure 5A:
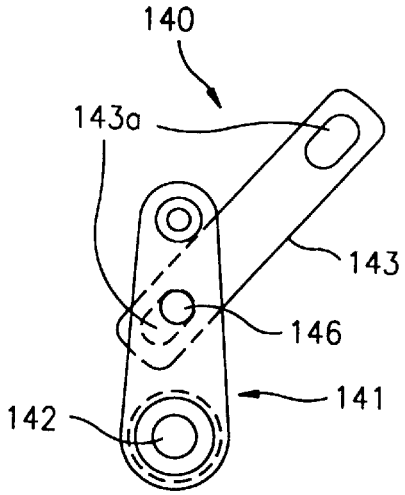
FIG.5A CONVENTIONAL ART
FIG. 5A is a front view illustrating a subordinate driving shaft link unit of the conventional two-position switching in FIG. 2.
Figure 5B:
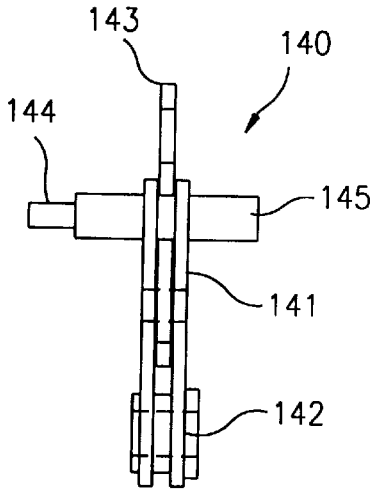
FIG.5B CONVENTIONAL ART
FIG. 5B is a side view illustrating the subordinate driving shaft link unit in FIG. 5A.
Figure 6:
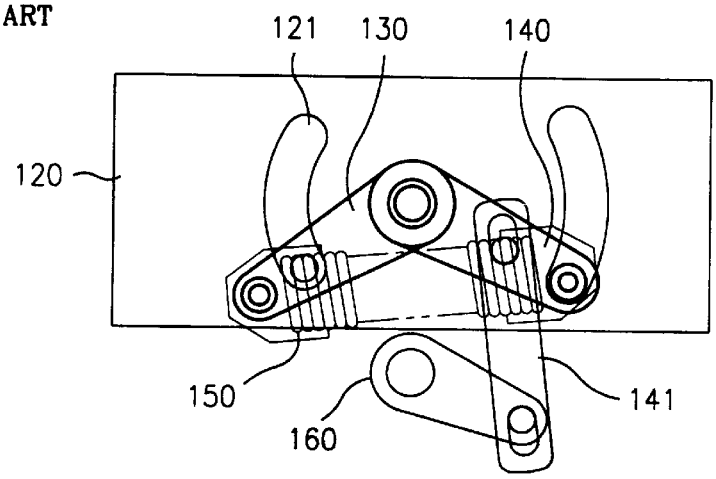
FIG. 6 CONVENTIONAL ART
FIG. 6 is an operational view illustrating a state of the conventional two-position switching actuator in FIG. 2 when the driving shaft unit and the subordinate driving shaft link unit are positioned in their initial locations.
Figure 7:
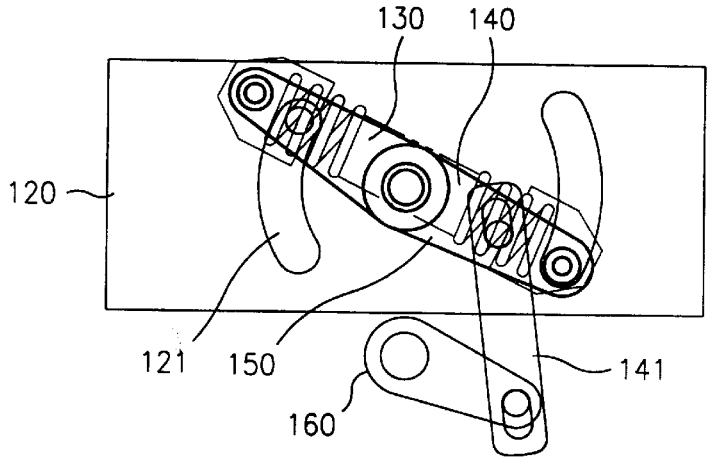
FIG. 7 CONVENTIONAL ART
FIG. 7 is an operational view illustrating a state of the conventional two-position switching actuator in FIG. 2 when the driving shaft unit rotatably reaches an end portion of an arc opening formed in a base plate of the actuator.
Figure 8:
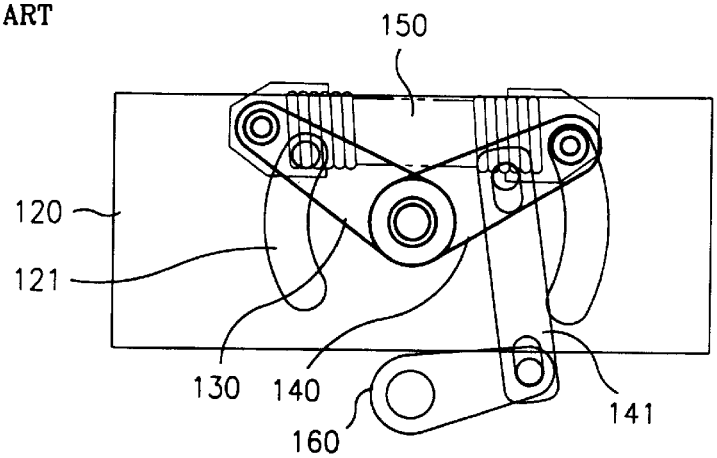
FIG. 8 CONVENTIONAL ART
FIG. 8 is an operational view illustrating a state of the conventional two-position switching actuator in FIG. 8 after the subordinate driving shaft link unit rotates due to an elastic restoration force of a spring wherein a contact point is shifted accordingly.

With reference to the accompanying drawings, the multi-position switching actuator for a load switch according to the present invention will now be described.

FIGS. 9 through 13 illustrate different perspectives of the multi-position switching actuator for a load switch according to the present invention. As shown therein, the multi-position switching actuator includes: an oil pressure cylinder unit 400 operated by applied power, a latch releasing unit 500 rotated in correspondence to the oil pressure cylinder unit 400, a latch unit 600 fixedly engaged to the latch releasing unit 500 and rotating in correspondence to a rotation of the latch releasing unit 500, a latch stopper 700 connected to the latch unit 600 and limiting a rotation of the latch unit 600 by a predetermined angle, an elastic member 800 disposed in the latch releasing unit 500 for thereby biasing the latch unit 600, and a central shaft 900 inserted through the latch unit 600 from a rear portion of the latch unit 600 toward the front of the latch unit 600.

Figure 14:
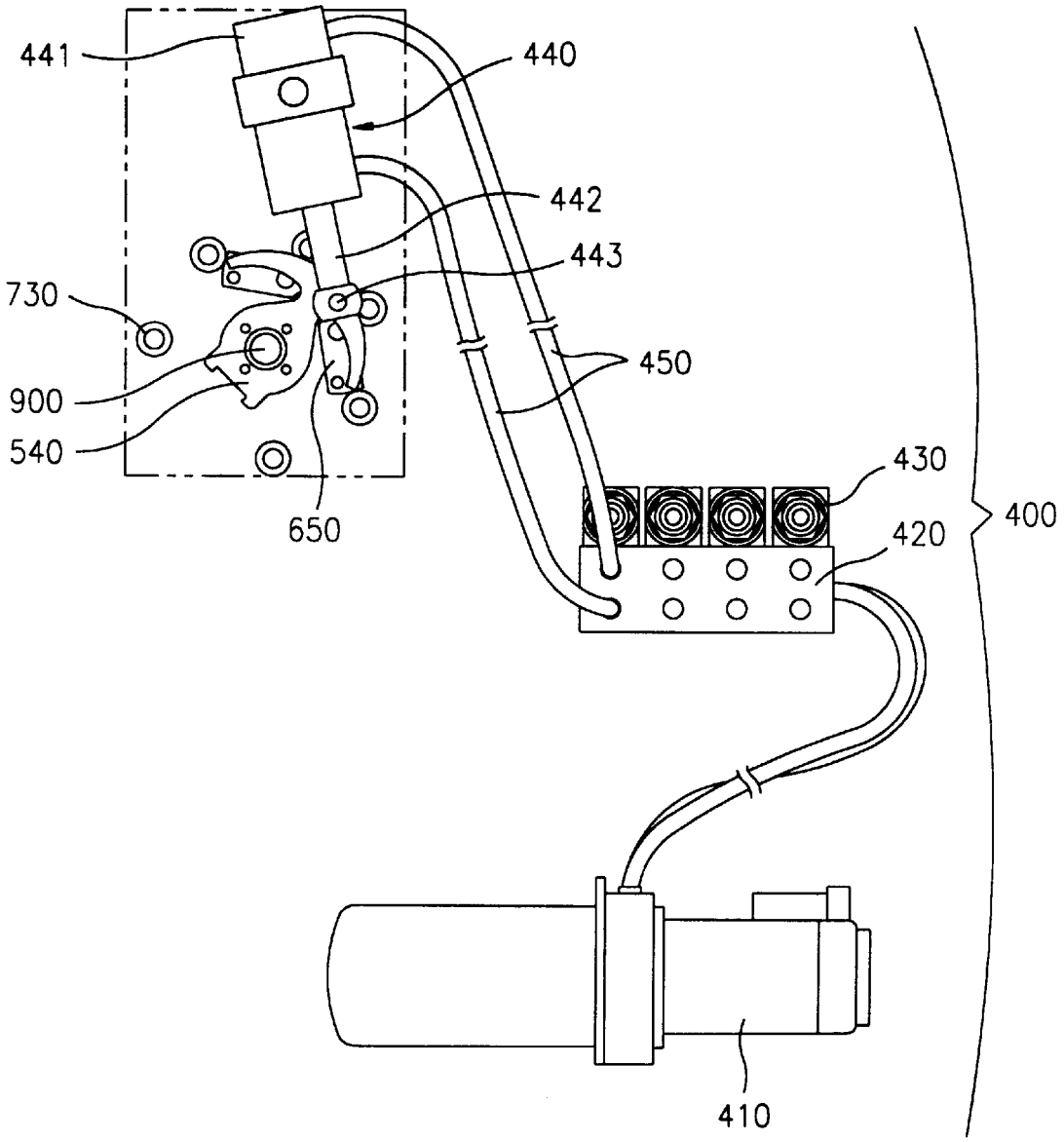
FIG. 14 is a diagram illustrating an oil pressure cylinder member of the multi-position switching actuator in FIG. 9 according to the present invention.

As shown in FIG. 14, the oil pressure cylinder unit 400 includes a power pack 410 operated by power, a manifold 420 connected to the power pack 410 and receiving oil therefrom, a solenoid valve 430 positioned on an upper surface of the manifold 420 and controlling the oil flow by the power, and a cylinder unit 440 fixed on the latch releasing unit 500, connected with the manifold 420 and operated by the pressure of the oil supplied from the manifold 420.

The cylinder unit 440 includes a cylinder 441 having each upper and lower portion connected with an oil tube 450, a push rod 442 reciprocating in a vertical motion by the pressure of the oil which flows from the manifold 420 to the cylinder 441 through the oil tubes 450, and a connecting portion 443 disposed at an end portion of the push rod 442 and connected with the latch releasing unit 500.

The latch releasing unit 500 includes: a pin connecting portion 512*a* engaged to the connecting portion 443 disposed at the end portion of the push rod 442; a stable plate 510 having a through hole 511 formed in the center of the stable plate 510 and serving as a circular opening for receiving the central shaft 900 therethrough; a spring support plate 520 extending from a lower portion of the stable plate 510 and bent inwardly by about 90 degrees; a spool 530 disposed at a rearward location from the stable plate 510 and having an identical axis to the stable plate 510 for being wound by the elastic member 800, e.g., a spring; a latch releasing plate 540 formed vertically near a rear portion of the spool 530; and an engagement pin 550 for coupling the stable plate 510 to the latch releasing plate 540.

An upper portion of the stable plate 510 is rearwardly stepped by about 90 degrees, and an end portion of the stepped portion is upwardly stepped. Here, the end portion is the pin connecting portion 512*a*, and an insertion hole 512*a* is formed at an upper part of the portion 512 for receiving the engagement pin 550.

The spool 530 is provided with a through hole 531 formed along the axis of the spool 530 and the central shaft 900 passes through the hole 531.

A through hole 541 is formed through the center of the latch releasing plate 540 in order for the central shaft 900 to pass therethrough, and a plurality of bolt holes 542 are formed around the through hole 541. An engagement hole 543 is formed in an upper portion of the latch releasing plate 540 for thereby receiving the engagement pin 550.

At each side of a top part of the latch releasing plate 540 there is formed a guide opening 544 which has an inwardly decreasing rotational radius.

In the latch releasing unit 500, the connecting portion 443 is placed between the engagement hole 512*a* formed in the upper portion stepped upwardly from the stable plate 510 and the engagement hole 543 formed in the upper portion of the latch releasing plate 540, and the engagement pin 550 is inserted therethrough.

The latch unit 600 includes: a first driving plate, that is, the front driving plate 610; a first spring support plate 620 extending and forwardly stepped by about 90 degrees from a lower portion of the front driving plate 610; a rear driving plate 630, (a second driving plate) fixed via an arrangement including the latch pin 680 to a rear surface of the front driving plate 610; a second spring support plate 640 extending and forwardly stepped by about 90 degrees from a lower portion of the rear driving plate 610; a latch 650 disposed between the front driving plate 610 and the rear driving plate 630 for thereby being hooked on a latch roller 730 of a latch stopper 700; a latch pin 660 extending forwardly from an end portion of the latch 650 and being disposed within the respective guide opening 544 of the latch releasing unit 500; and a spring 670 for receiving a rear end portion of the rotation shaft 680 for thereby allowing the latch 650 to have an elastic restoration force.

The front and rear driving plates 610, 630 are fixedly engaged via an arrangement including the latch pin 650 to each other wherein a front side of the rear driving plate 630 faces a back side of the front driving plate 610.

An end portion 800*a* and another end portion 800*b* of the elastic member 800, which is wound around the spool 530 of the latch releasing unit 500, are biasedly abutting the respective end portions of the first and second spring support plates 620, 640 therebetween.

Each of the front and rear driving plates 610, 630 extends wider as it extends upwardly, respective top ends of the front and rear driving plates 610, 630 are respectively formed in a circular arc type, and through holes 611, 631 are formed through the central portions of the front and rear driving plates 610, 630 for receiving the central shaft 900 therethrough. A plurality of bolt holes 612, 632 are formed around the through holes 611, 631.

Insertion holes 613, 633 are formed in upper side portions of the front and rear driving plates 610, 630 for thereby allowing the rotation shafts 680 of the latch 650 to be inserted therethrough, and at each side of the front and rear driving plates 610, 630 there are also provided pin hooking wings 614, 634 for abutting against the latch pins 660.

The latch stopper 700 includes: a base plate 710 having a through hole 711 formed through the center thereof for thereby allowing the central shaft 900 to pass therethrough, and a plurality of bolt holes 712 formed around the through hole 711; a plurality of latch roller stable shafts 720 spaced from each other in an arc type with regard to the base plate 710; a plurality of latch rollers 730 for being fixed onto corresponding ones of the latch roller stable shafts 720; and a C-shaped latch roller stable plate 740 for receiving respective end portions of the latch roller stable shafts 720 therewithin.

An end portion of each of the latch roller stable shafts 720 is inserted into a corresponding one of the latch rollers 730, and another end portion thereof is inserted into a corresponding one of the bolt holes 712 formed in the base plate 710. The latch roller stable shafts 720 are fixed by fixing members, e.g., bolts 750. At the middle portion of each of the latch roller stable shafts 720 there is provided a jaw unit 720*a* serving to limit the insertion of the latch rollers 730.

A plurality of insertion holes 741 are formed along the latch roller stable plate 740 for thereby receiving respective end portions of the latch roller stable shafts 720.

The operational steps of the thusly composed multi-position switching actuator for a load switch according to the present invention will now be explained.

As shown in FIG. 14, the power pack 410 provided with a pump, a motor, and an oil tank operates when power is applied to the power pack 410, and oil in the oil tank is flowed into one side of the small-sized manifold 420 by the operation of the power pack 410.

A flow route of the oil supplied to the manifold 420 is controlled by the solenoid valve 430 in accordance with an applied electrical signal.

The oil flowed into the manifold 420 travels to the cylinder 441 through the oil tube 450, thus generating oil pressure, and the push rod 442 connected to a bottom part of the cylinder 441 reciprocates in a vertical motion by the oil pressure.

In other words, when power is applied to the solenoid valve 430, the solenoid 430 enables the oil supplied to the manifold 420 to flow into the upper portion of the cylinder 441 through the oil tube 450, and the oil supplied to the lower portion of the cylinder 441 is discharged back to the manifold 420, whereby, oil pressure from the oil flow is increased, and the oil pressure downwardly thrusts the push rod 442 which is movably connected with the lower portion of the cylinder 440.

In addition, when power is applied to the solenoid valve 430, the solenoid valve 430 causes the oil in the manifold 420 to flow into the lower portion of the cylinder 441 through the oil tube 450, and the oil in the upper portion of the cylinder 441 is discharged back to the manifold 420. At this time, oil pressure is produced due to the inflow and discharge of the oil, and the push rod 442, which is movably connected with the lower portion of the cylinder 441, thrusts in a downward direction by the oil pressure.

In case where the power is applied to the solenoid valve 430 when the switch is in the off position, the solenoid valve 430 interrupts the oil flowing into the manifold 420.

Thus, the oil stored in the cylinder 441 flows only through the lower and upper portions of the cylinder 441, and therefore it is possible for an operator to manually operate the switch for repairs and checkup.

Figure 10:
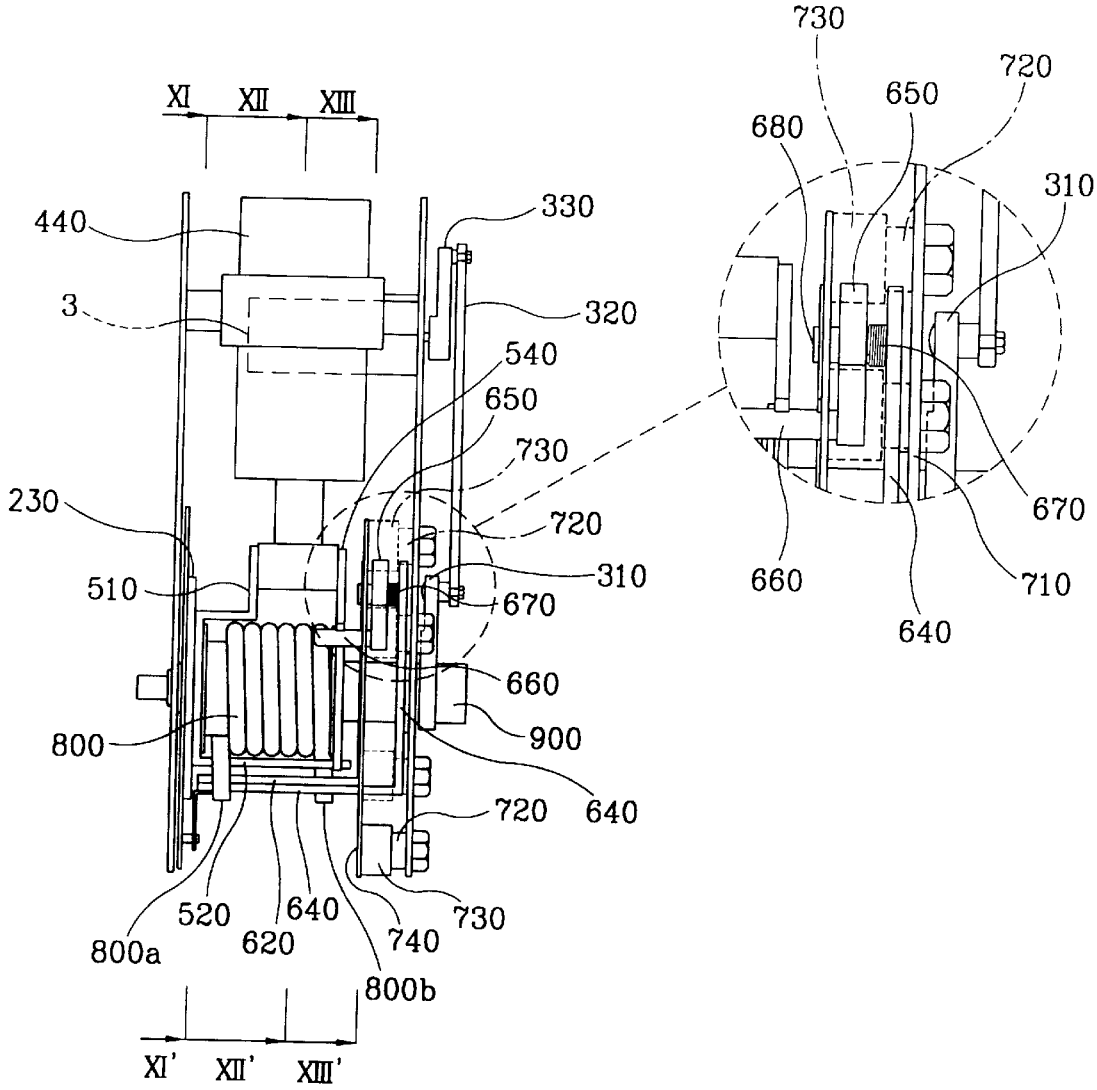
FIG. 10 is a side view of the multi-position switching actuator in FIG. 9 according to the present invention.
Figure 11:
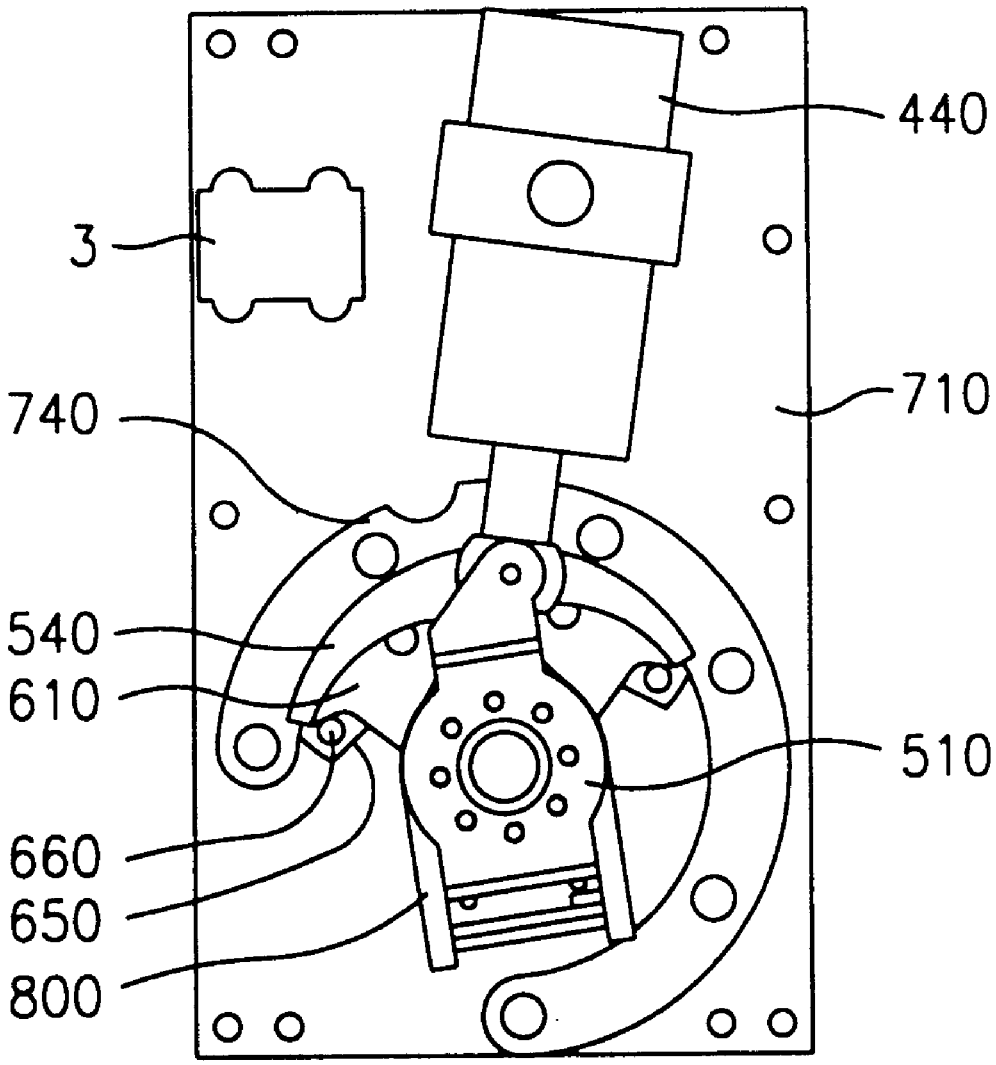
FIG. 11 is a cross-sectional view taken along line XI–XI' in FIG. 10 for illustrating an internal composition of the multi-position switching actuator for a load switch according to the present invention.
Figure 12:
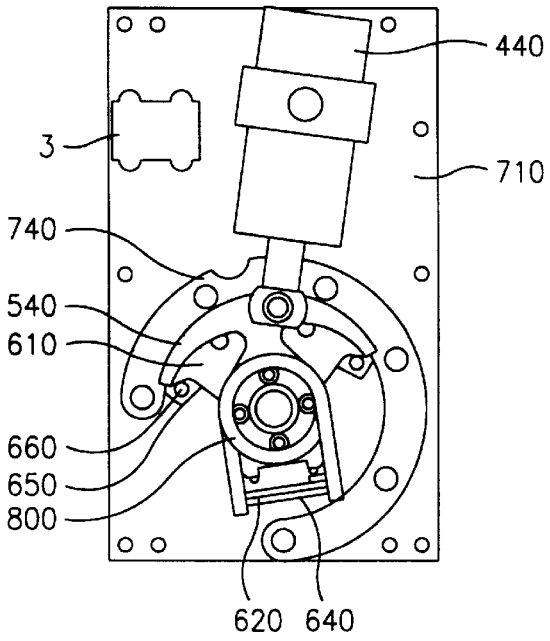
FIG. 12 is a cross-sectional view taken along line XII–XII' in FIG. 10 for illustrating an internal composition of the multi-position switching actuator for a load switch according to the present invention.
Figure 13:
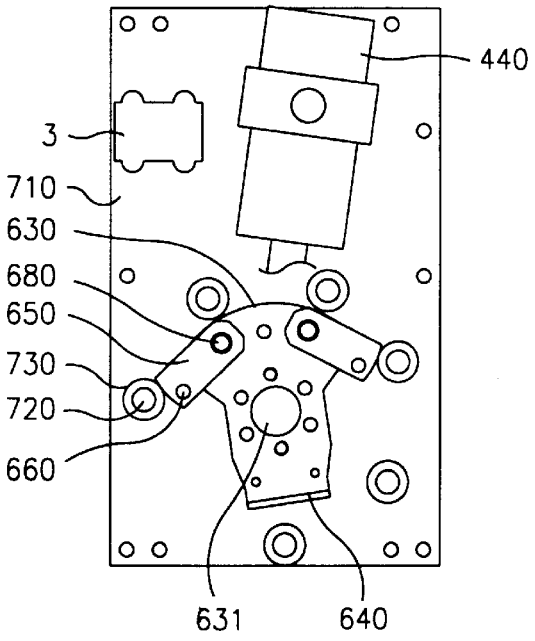
FIG. 13 is a cross-sectional view taken along line XII-I–XIII' FIG. 10 for illustrating an internal composition of the multi-position switching actuator for a load switch according to the present invention.
Figure 15:
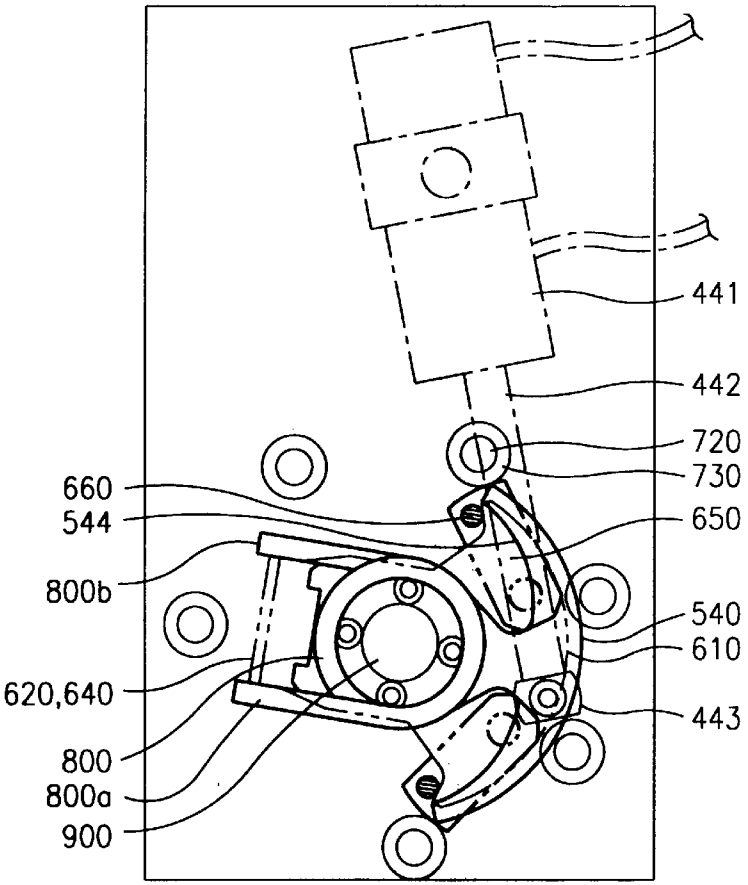
FIG. 15 is an operational view illustrating a state in which the multi-position switching actuator in FIG. 9 is in its initial location.

When the push rod 442 vertically reciprocates, the stable plate 510 of the latch releasing unit 500 also rotates, as shown in FIGS. 10 and 15.

At this time, since the stable plate 510, the spring support plate 520, and the latch releasing plate 540 are fixedly engaged to each other by fixing members, such as bolts and nuts, when the stable plate 510 rotates, these plates 510, 520, 540 rotate as a single unit according to the operation of the stable plate 510.

Figure 16:
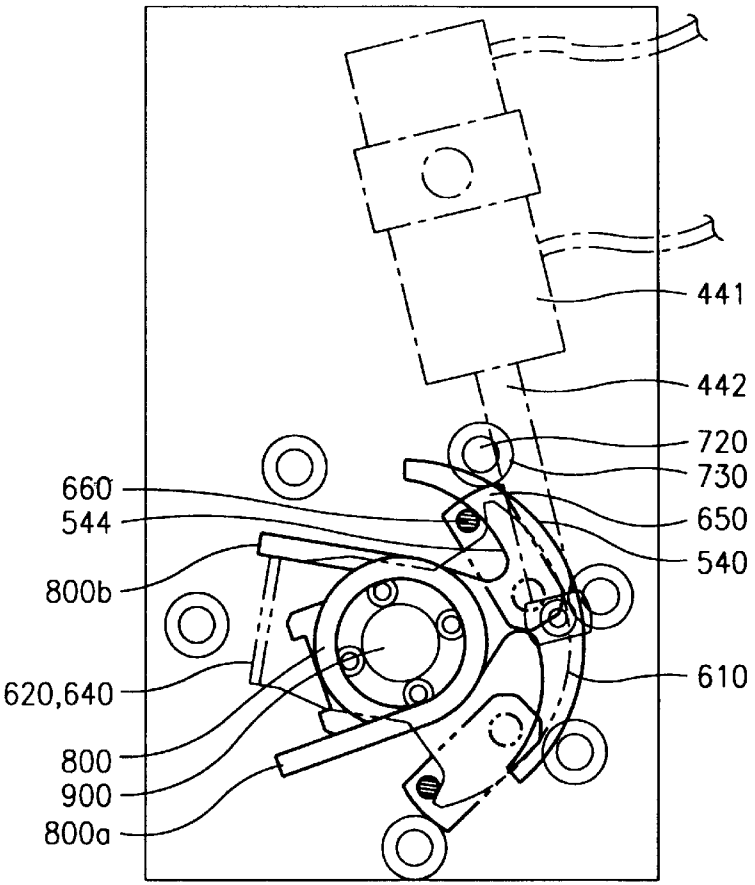
FIG. 16 is an operational view illustrating a state in which a latch pin of the multi-position switching actuator in FIG. 9 begins to be hooked in a guide opening formed in a latch releasing plate of the actuator according to the present invention.

When the stable plate 510 makes its rotation, as shown in FIGS. 10 and 16, the elastic restoration force of the elastic member 800 is applied to the spring support plate 520 which is hooked on by the end portions 800*a*, 800*b* of the elastic member 800. The spring support plate 520 makes its rotation according to the rotation member 400 that is attached to the handle 200.

The first and second spring support plates 620, 640 respectively extending forwardly from the lower portions of the front and rear driving plates 610, 630, which are hooked by the end portion 800*b* of the spring 800 together with the spring support plate 520, allow the latch 650 to abut against one latch roller 730, thereby pressing the elastic member 800 without rotating.

When the spring support plate 520 makes its rotation together with the end portion 800*a* of the elastic member 800, the latch releasing plate 540 engaged to the spring support plate 520 is also rotated accordingly.

Figure 17:
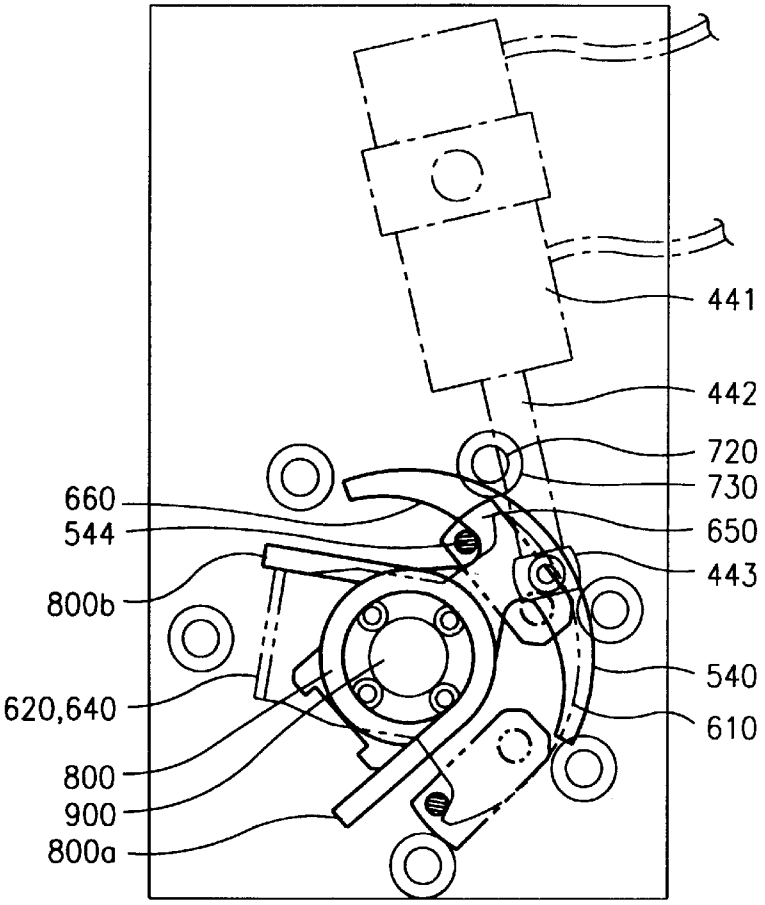
FIG. 17 is an operational view illustrating a state in which latch pin of the multi-position switching actuator in FIG. 16 begins to be pressed downwardly by the guide opening formed in a latch releasing plate of the actuator.

As shown in FIG. 17, when the latch releasing plate 540 makes its rotation, each of the guide openings 544 formed in the side portion of the latch releasing plate 540 is also rotated, so that the latch pin 660 of the latch 650 that temporarily abuts against a middle portion of the guide opening 544.

Specifically, when the latch releasing plate 540 makes its rotation, the latch pin 660 disposed at an entrance to the guide opening 544 moves toward the middle portion of the guide opening 544. The rotational radius of the guide opening 544 becomes smaller toward its interior, and accordingly when the rotation of the latch releasing plate 540 continues, the latch pin 660 gradually moves downwardly from the middle portion of the guide opening along the guide opening 544.

When the latch pin 660 makes its downward movement, the latch 650 is downwardly pressed in proportion thereto, thereby rotating downwardly while having the rotation shaft 680 as its rotation axis. When the latch releasing plate 540 makes its rotation by a predetermined angle in accordance with the continuous rotation of the latch releasing plate 540, the latch 650 is released from the one latch roller 730.

Figure 18:
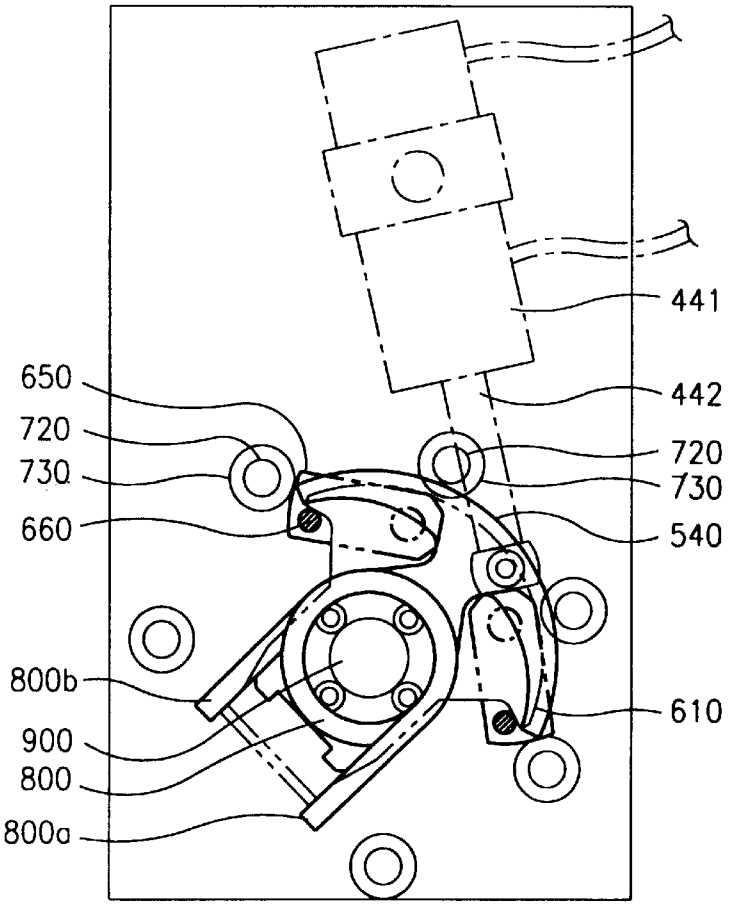
FIG. 18 is an operational view illustrating a state in which front and rear driving plates of the multi-position switching actuator in FIG. 17 according to the present invention are rotated in accordance with an elastic restoration force of a spring for switching contact points.

As shown in FIG. 18, the moment the latch 650 is released from the one latch roller 730, the front and rear driving plates 610, 630 make their instant rotation in correspondence to the elastic restoration force of the elastic member 800 which is pressed by the first and second spring support plates 620, 640.

Therefore, when the front and rear driving plates 610, 630 make their rotation, the central shaft 900 fixed thereto is rotated, and accordingly an internal contact within the load switch according to the present invention is shifted to another desired contact position.

The shifting of a contact to another position becomes possible by installing the latch roller stable shafts 720 and the latch rollers 730 which are selectively hooked by the latch 650.

Figure 9:
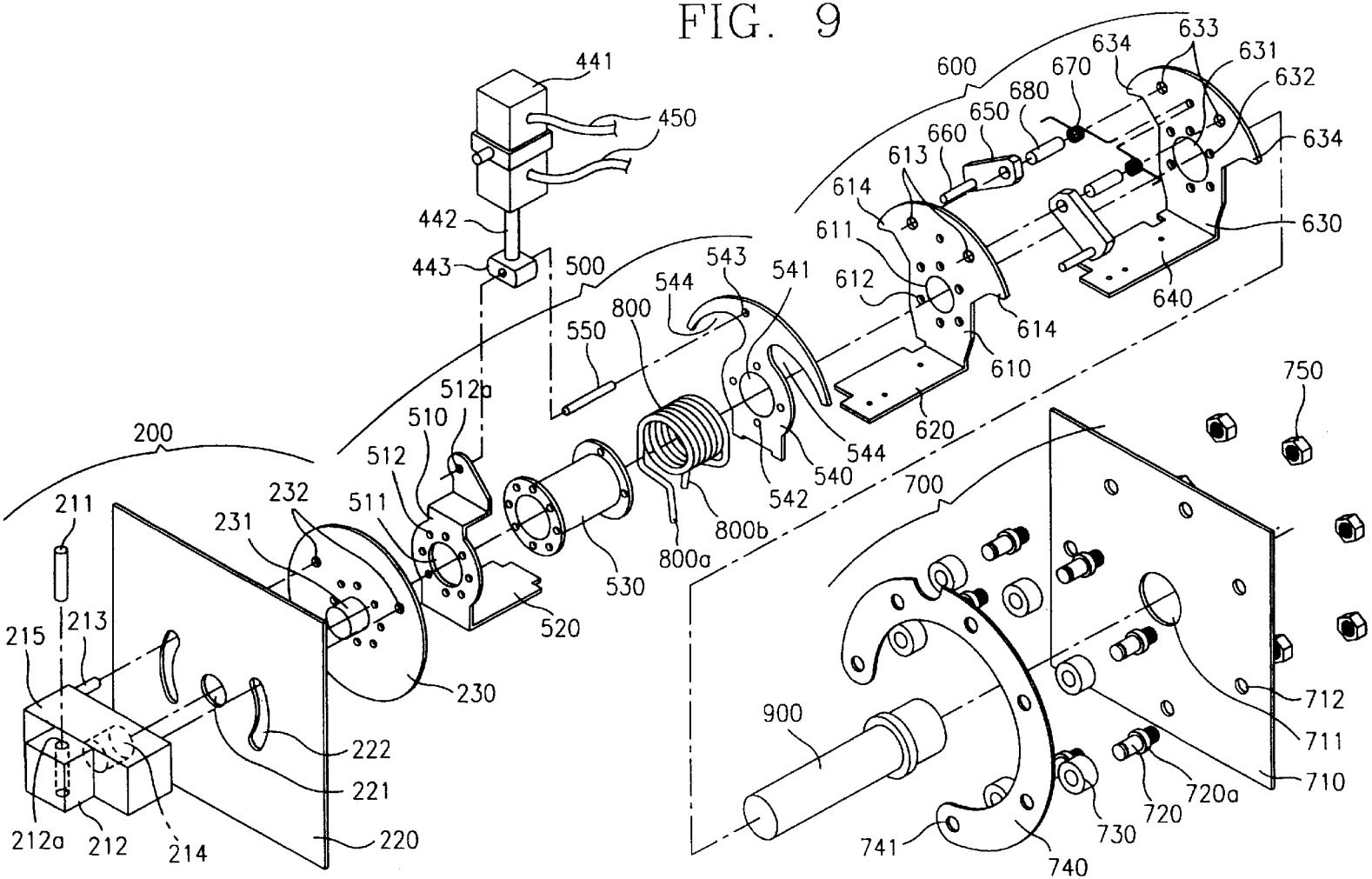
FIG. 9 is an exploded perspective view of a multi-position switching actuator for a load switch according to the present invention.

Additionally, in the multi-position automatic switching actuator for a load switch according to the present invention, the contact switching operation may be manually performed by installing a manual operating unit 200 in front of the latch releasing unit 500 as shown in FIG. 9.

The manual operating unit 200 includes a control handle unit 210, a rotation disk 230 disposed at a portion spaced from a rear portion of the control handle unit 210 and rotating in accordance with the rotation of the control handle unit 210, and a front plate 220 disposed between the control handle unit 210 and the rotation disk 230 for thereby limiting the rotation of the control handle unit 210.

The control handle unit 210 includes a lever 211, and a control handle 215 having a protrusion 212 having an insertion hole 212*a* for receiving the lever 211, a control protrusion 213 extending from a rear surface thereof, and an insertion groove 214 formed in a central portion thereof.

The rotation disk 230 includes a central protrusion 231 which is inserted into the insertion groove 214 of the control handle 215 and at least one control hole 232, into which the control protrusion 213 of the control handle 215 is inserted, are formed at the upper portion of the rotation disk.

A through hole 221 is formed through the center of the front plate 220 in order for the central protrusion 231 of the rotation disk 230 to pass therethrough, and an arc control opening 222 is formed to the left and right of the through hole 221 in order to limit the rotation of the control handle 215.

With reference to the accompanying drawings, the operation of a manual operating method according to an embodiment of the multi-position automatic switching actuator for a load switch according to the present invention will now be described.

To start the manual operation of the multi-position automatic switching actuator for a load switch according to the present invention, an operator puts the load switch in the off position manually or by controlling a control switch of the load switch from a remote area.

When the load switch of the present invention is in the off position, power is not applied to the solenoid valve 430, oil is cut off from the manifold 420, and the oil flow will be stopped.

As shown FIG. 9, the operator inserts the central protrusion 231 of the rotation disk 230 into the insertion groove 214 of the control handle 215 as well as the control protrusion 213 of the control handle 215 into a control hole 232 of the rotation disk 230. Then, the push rod 442, which was movably engaging with the lower portion of the cylinder 441, vertically reciprocates by force, thereby enabling the manual operation.

Also, the multi-position automatic switching actuator for a load switch according to the present invention may enable the operator to recognize a state of the contact point by disposing a link member between the central shaft 900 and a cam switch 3 which indicates the state of the contact point by an electrical signal.

Figure 19:
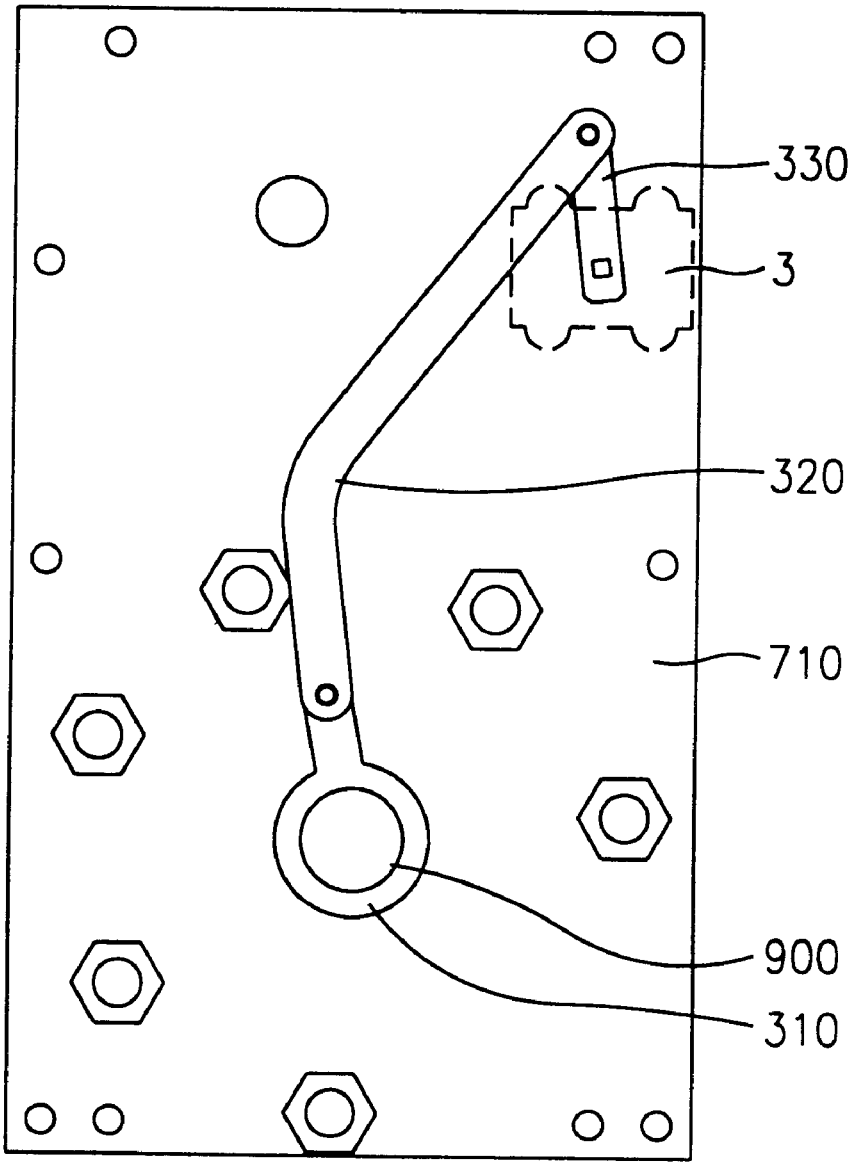
FIG. 19 is a rear view illustrating a state in which a link member is fixed to the multi-position switching actuator in FIG. 9 according to the present invention.

As shown in FIG. 19, the link member 300 is vertically disposed at a back side of the latch stopper 700, and includes a first end engaged with an end portion of a rear side of the central shaft 900 and a second end engaged with the cam switch 3.

The link member 300 includes a driving link 310 having one end portion engaged with the end portion of the central shaft 900, a first subordinate link 320 having a bent and one end portion engaged with the other end portion of the driving link 310 in order to change rotational degrees of the central shaft 900, which is transmitted from the driving link 310 in accordance with an electrical signal, to rotation control degrees of the cam switch 3, and a second subordinate link 330, having one end portion engaged with the first subordinate link 320 and the other end portion engaged with the cam switch 3, thereby rotating the cam switch 3 in accordance with the rotation control degrees of the cam switch 3 transmitted from the first subordinate link 320.

The method of recognizing the state of the contact point according to an another embodiment of the multi-position automatic switching actuator of a load switch according to the present invention will be described with reference to the accompanying drawings.

Figure 22:
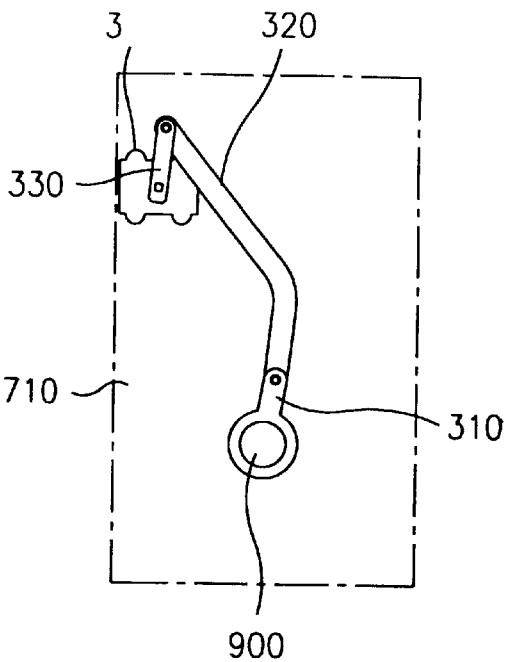
FIG. 22 is an operational view illustrating a location of the link member in FIG. 22 when the central shaft of the multi-position switching actuator according to the present invention rotates in the counter-clockwise direction by 54 degrees from the state of FIG. 21.
Figure 21:
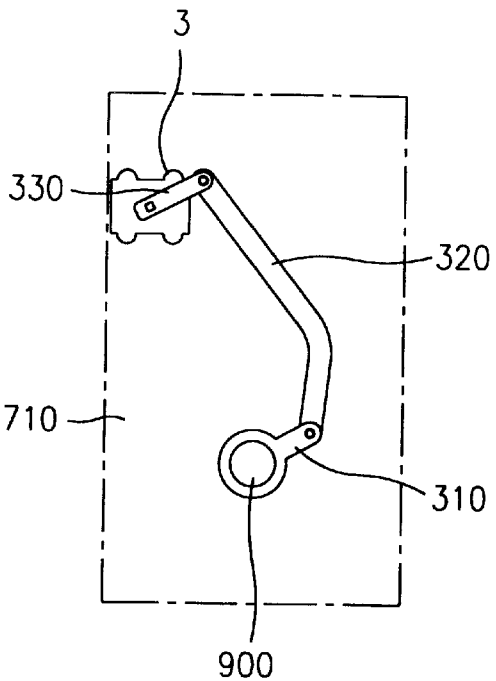
FIG. 21 is an operational view illustrating a location of the link member in FIG. 19 when the central shaft of the multi-position switching actuator according to the present invention rotates in the counter-clockwise direction by 54 degrees.
Figure 20:
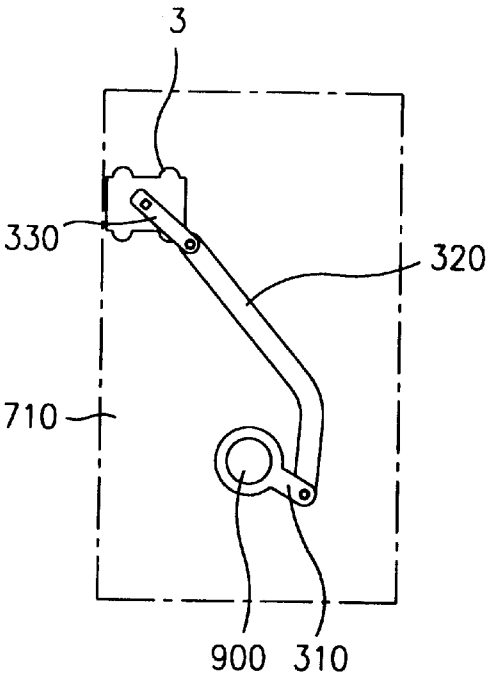
FIG. 20 is an operational view illustrating a location of the link member in FIG. 19 when a central shaft of the multi-position switching actuator according to the present invention is in its initial location.

In the method of recognizing the state of the contact point of the multi-position automatic switching actuator of a load switch according to the present invention as shown in FIGS. 20 to 22, when the central shaft 900 rotates in accordance with the operation of the latch releasing unit 600, the degree (or amount) for which the central shaft 900 rotates is transmitted to the link member 300 by an electrical signal, which is changed to the rotation control degree for controlling the rotating operation of the cam switch 3.

That is, for example, when the central shaft 900 rotates by 54 degrees in order to switch to another contact point, the rotational degree, 54°, are transmitted to the driving link 310, and the driving link 310 transmits the rotational degree of the central shaft 900 to the first subordinate link 320. Next, the first subordinate link 320 transforms the rotational degree of the central shaft 900, that is 54°, into a rotation control degree for the cam switch 3, i.e., 60°, and transmits the rotation control degree to the second subordinate link 330.

Consequently, the second subordinate link 330 rotates the cam switch 3, thus indicating a new state of the contact point.

As described above, the multi-position automatic switching actuator for a load switch according to the present invention makes it possible to appropriately switch a contact point to another and to carry out a 3-position switching control, a four-position switching control and a multi-position switching control by employing a single actuator, thereby simplifying production, minimizing parts required and size, and decreasing production cost.

In addition, the multi-position automatic switching actuator for a load switch according to the present invention enables the operator to switch the contact point from a distance, thus reducing operation time and securing safety in work operations.

As the present invention may be embodied in several forms without departing from the spirit of essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within meets and bounds of the claims, or equivalences of such meets and bounds are therefore intended to embrace the appended claims.

What is claimed is:

1. A multi-position automatic switching actuator for a load switch, comprising:

an oil pressure cylinder unit operating and reciprocating by electrical power applied thereto;

a latch releasing unit rotating in accordance with the reciprocation of the oil pressure cylinder unit;

a latch driving unit coupled to the latch releasing unit;

a latch stopping unit, coupled to the latch driving unit by a central shaft, for limiting the rotation of the latch unit by a predetermined angle; and an elastic member, disposed in the latch releasing unit, for biasing rotation of the latch releasing unit relative to the latch driving unit.

2. The actuator of claim 1, wherein the oil pressure cylinder unit comprises:

a power pack operated by the electrical power;

a manifold connected to the power pack and receiving oil from the power pack;

a solenoid valve disposed on an upper portion of the manifold and controlling an oil flow to and from the manifold; and a cylinder unit disposed on the latch releasing unit, connected with the manifold, and operated by pressure of the oil supplied from the manifold.

3. The actuator of claim 2, wherein the cylinder unit comprises:

a cylinder having each of upper and lower portions separately connected to the manifold;

a push rod movably disposed in the cylinder and reciprocating by the pressure of the oil flowing between the manifold and the cylinder; and a connecting portion disposed at an end portion of the push rod and connected with the latch releasing unit.

4. The actuator of claim 3, wherein the latch releasing unit rotates in a predetermined direction when the push rod of the cylinder unit vertically reciprocates by the pressure of the oil flow.

5. The actuator of claim 4, wherein the latch releasing unit comprises:

a pin connecting portion engaged to the connecting portion disposed at the end portion of the push rod;

a stable plate having a first hole in the center of the stable plate so that the central shaft passes therethrough;

a spring support plate extending from a lower portion of the stable plate and being bent inwardly at a certain angle;

a spool surrounded by the elastic member and receiving the central shaft therethrough;

a latch releasing plate having a second hole for receiving the central shaft therethrough; and an engagement pin for engaging the stable plate to the latch releasing plate.

6. The actuator of claim 5, wherein the pin connecting portion includes a first portion extending from an upper portion of the stable plate at 90 degrees, a second portion extending from the first portion at an angle, and an insertion hole for receiving the engagement pin.

7. The actuator of claim 5, wherein the latch releasing plate her includes a guide opening formed at each of first and second sides of the latch releasing plate.

8. The actuator of claim 7, wherein each of the guide openings is symmetric, relative to an axis of symmetry between said first and second sides, and is arcuate in shape, a radius of said arcuate shape diminishing with rotation toward said axis of symmetry.

9. The actuator of claim 1, the latch driving unit comprises:

a first driving plate for receiving the central shaft therethrough;

a first spring support plate extending from a lower portion of the first driving plate at an angle;

a second driving plate being fixed to a portion of the first driving plate;

a second spring support plate extending from a lower portion of the second driving plate at an angle;

at least one latch disposed between the first driving plate and the second driving plate for selectively abutting against a latch roller of the latch stopping unit;

at least one rotational shaft inserted into a portion of the respective latch for allowing the respective latch to rotate when the respective latch is pressed by the latch releasing unit; and at least one spring for receiving the respective rotational shaft and applying elastic restoration force to the respective latch.

10. The actuator of claim 1, wherein each of the first and second driving plates includes a third hole for receiving the central shaft therethrough, a plurality of fourth holes formed in upper side portions of the first and second driving plates, respectively; for receiving the respective rotational shaft therethrough, and at least one pin hooking wing formed at an upper side portion of the first and second driving plates for selectively abutting against the latch pin of the latch.

11. The actuator of claim 9, wherein the latch includes a latch pin forwardly extending from a portion of the latch, and an insertion hole formed in another portion of the latch for a rotation shaft therethrough.

12. The actuator of claim 1, wherein the latch stopping unit comprises:

a base plate having a hole formed through a center thereof for receiving the central shaft therethrough;

a plurality of latch roller stable shafts spaced from each other in an arc configuration and formed on the base plate;

a plurality of latch rollers correspondingly coupled to the latch roller stable shafts; and a latch roller stable plate for receiving the latch roller stable shafts therein.

13. The actuator of claim 12, wherein an end portion of each of the latch roller stable shafts is inserted into a corresponding one of the latch rollers, another end portion of each of the latch roller stable shafts is inserted into a corresponding one of bolt holes formed in the base plate, each of the latch roller stable shafts is threaded for engagement with the base plate, and a middle portion of each of the latch roller stable shafts includes a flange serving to limit the insertion of the respective latch roller.

14. The actuator of claim 12, wherein the latch roller stable plate has a C-shaped configuration and a plurality of insertion holes for receiving respective end portions of the latch roller stable shafts.

15. The actuator of claim 1, wherein the elastic member includes end portions to engage the latch releasing unit and the latch driving unit.

16. The actuator of claim 1, further comprising:

a manual operation unit connectable to a front portion of the latch releasing unit for manually switching a contact point of the actuator.

17. The actuator of claim 16, wherein the manual operation unit comprises:

a control handle unit having a first protrusion;

a rotation disk having a recess into which engages said first protrusion of said control handle unit, said rotation disk rotating in accordance with a rotation of the control handle unit and being coupled to the latch releasing unit; and a front plate, disposed between the control handle unit and the rotation disk, having an aperture through which passes said first protrusion of said control handle unit, edges of said aperture limiting the rotation of the control handle unit by limiting motion of said first protrusion.

18. The actuator of claim 17, wherein the control handle unit comprises:

a lever; and a control handle including a second protrusion having an insertion hole for receiving the lever, and an insertion groove formed in the control handle.

19. The actuator of claim 18, wherein the rotation disk includes a central protrusion being inserted into the insertion groove of the control handle.

20. The actuator of claim 19, wherein the front plate includes a hole formed in the front plate for receiving the central protrusion of the rotation disk therethrough.

21. The actuator of claim 1, further comprising:

a linking unit disposed between the central shaft and an electrical cam switch so as to actuate the cam switch, a state of the cam switch being indicative of a state of a contact point of the actuator.

22. The actuator of claim 21, wherein the linking unit is vertically disposed at a back side of the latch stopping unit.

23. The actuator of claim 22, wherein the linking unit comprises:

a driving link having one end portion which is engaged with the central shaft;

a first subordinate link having one end portion which is engaged with another end portion of the driving link, the first subordinate link being bent, the first subordinate link transferring rotation of the driving link; and a second subordinate link having one end portion which is movably engaged with the first subordinate link and another end portion which is engaged with the cam switch, the second subordinate link transferring rotation from the first subordinate link to the cam switch.

24. The actuator of claim 1, wherein the latch releasing unit includes a latch releasing plate rotating in a first direction in accordance with the reciprocation of the oil pressure cylinder unit, the rotating latch releasing plate causing an engagement pin in the latch releasing unit to move in the first direction.

25. A method of automatically switching a contact position of a multi-position automatic switching actuator for a load switch, the method comprising:

(a) reciprocating an oil pressure cylinder unit by applying power thereto;

(b) rotating a latch releasing unit in accordance with the reciprocation of the oil pressure cylinder unit;

(c) rotating a latch in a latch driving unit coupled to the latch releasing unit in accordance with the rotation of the latch releasing unit by an operation of an elastic member disposed in the latch releasing unit; and (d) limiting the rotation of the latch by a predetermined angle using a latch stopping unit coupled to the latch driving unit.

26. The method of claim 25, wherein the step (b) rotates a latch releasing plate of the latch releasing unit in a first direction in accordance with the reciprocation of the oil pressure cylinder unit, which moves an engagement pin in the latch releasing unit in the first direction.

27. The method of claim 26, wherein the movement of the engagement pin in the first direction causes the step (c) to rotate the latch.

* * * * *